US006824414B2

(12) United States Patent
Whyne et al.

(10) Patent No.: US 6,824,414 B2
(45) Date of Patent: Nov. 30, 2004

(54) ZERO INSERTION FORCE SOCKET TERMINAL

(75) Inventors: Richard Nicholas Whyne, Mechanicsburg, PA (US); Benjamin Howard Mosser, III, Middletown, PA (US); David Allison Trout, Wrightsville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/008,410

(22) Filed: Nov. 13, 2001

(65) Prior Publication Data

US 2003/0092304 A1 May 15, 2003

(51) Int. Cl.[7] ..... H01R 4/50
(52) U.S. Cl. ..... 439/342
(58) Field of Search ..... 439/342, 71, 266, 439/259, 70, 344, 856, 857, 268, 66, 83, 388, 474

(56) References Cited

U.S. PATENT DOCUMENTS

| | | | | | |
|---|---|---|---|---|---|
| 3,676,832 | A | | 7/1972 | Judge et al. | 339/75 |
| 4,498,725 | A | | 2/1985 | Bright et al. | 339/176 |
| 4,988,310 | A | | 1/1991 | Bright et al. | 439/342 |
| 5,454,727 | A | * | 10/1995 | Hsu | 439/263 |
| 6,062,890 | A | * | 5/2000 | Pei et al. | 439/342 |
| 6,142,810 | A | * | 11/2000 | Hsiao et al. | 439/342 |
| 6,152,757 | A | * | 11/2000 | Szu | 439/342 |
| 6,206,735 | B1 | * | 3/2001 | Zanolli | 439/736 |
| 6,267,615 | B1 | * | 7/2001 | Lin | 439/342 |
| 6,319,038 | B1 | * | 11/2001 | Howell et al. | 439/342 |
| 6,371,784 | B1 | * | 4/2002 | Scholz et al. | 439/342 |
| 6,443,750 | B1 | * | 9/2002 | Lemke et al. | 439/341 |
| 6,454,588 | B1 | * | 9/2002 | Pickles et al. | 439/342 |
| 6,461,183 | B1 | * | 10/2002 | Ohkita et al. | 439/342 |
| 6,471,534 | B1 | * | 10/2002 | Lee | 439/342 |
| 6,478,598 | B1 | * | 11/2002 | Szu | 439/342 |
| 6,478,637 | B1 | * | 11/2002 | Ohkita et al. | 439/857 |

* cited by examiner

*Primary Examiner*—P. Austin Bradley
*Assistant Examiner*—Phuongchi Nguyen

(57) ABSTRACT

A terminal for use with a zero insertion force socket is disclosed which electrically connects a mating connector to a printed circuit board or the like. The terminal has a pin engaging portion which has a pair of nonsymmetrical contact arms which are positioned to make electrical engagement with the mating pin. A first contact arm of the pair of contact arms is configured to have a longer electrical path across which signals are transmitted than a second contact arm. The first contact arm also has a reduced cross section compared to the second contact arm, such that the first contact arm is configured to have a matched inductance to the second contact arm. A retention portion extends from the pin engaging portion. Side edges of the retention portion are dimensioned to create a frictional interference with side wall of a cavity of the socket. A mounting portion extends from the retention portion in an opposite direction from the pin engaging portion. The mounting portion has at least one resilient leg which extends from the retention portion to a solder pad which is soldered to a substrate. The solder pad is spaced from the retention portion a sufficient distance to allow the at least one resilient leg to provide the resilient characteristics required to allow the at least one resilient leg to resiliently compensate for misalignment or movement of the solder relative to the solder pad.

14 Claims, 3 Drawing Sheets

ZERO INSERTION FORCE SOCKET TERMINAL

FIELD OF THE INVENTION

The invention relates to a contact for use in a zero insertion force socket. In particular, the terminals have non-symmetrical redundant beams which allow the terminals to compensate for mispositioned pins of a mating connector.

BACKGROUND OF THE INVENTION

Zero insertion force sockets are known in the art. Generally, the socket has a base with terminals mounted therein and a cover which is slidably mounted on the base. Some type of cam means is provided to move the cover relative to the base.

The terminals provided in these prior art sockets are dimensioned to receive a mating pin therein. The pin is inserted into an open area of the terminal which requires a zero or minimal force for insertion. The cover with the pins mounted therein is then slid such that the pins move from the open area of the terminal to a restricted portion. In this restricted portion, the mating pins electrically engage arms of the terminals to provide the electrical connection therebetween. In one such socket, the portion of the terminal which mates with the mating pin has a first arm and a second arm extending from a connecting portion which connects the mating portion with a retention portion of the terminals herein. The first arm is significantly longer than the second arm. The first arm and second arm form a generally U-shaped cantilever member. The arms converge towards each other to form the restricted portion. When the mating pin is positioned in electrical engagement with the restricted portion, the first and second arms have different electrical resistance resulting in an unbalanced signal transfer between the arms. In addition, when the mating pins are improperly aligned in the socket, the mating portion is not adequately adjustable to adapt for the misposition of the pins. This is because the second contact arm is generally short and relatively rigid, thereby limiting its resiliency and preventing the second arm from adapting to the misaligned pin. In contrast, the lengthy first arm is resiliently deformable and can adjust to the misalignment of the pins. However, as the misaligned pin will not be held in electrical engagement with both the first and second arms of the terminal, an inconsistent electrical connection is provided.

U.S. Pat. No. 6,142,810 discloses a terminal wherein the electrical resistance between the pins and the terminals is a low. Each terminal has an engaging portion, a retention portion, a neck inter-connecting the engaging and retention portions, and a mounting pad. The engaging portion has a pair of cantilevers symmetrically arranged about a central line thereof and extending a predetermined distance from the neck in one direction and converging towards each other. The engaging portion rotates with respect to the neck such that the pair of cantilevers is reliably connected with a contact pin of the mating connector even when the pin is incorrectly positioned in the aperture. The retention portion has barbs for reliably retaining the terminal in the base. A mounting pad is positioned proximate to an extends perpendicular to the retention portion. While this terminal better compensates for mating pin misalignment, the close proximity of the mounting pad to the retention portion can result in an ineffective electrical connection between the terminals of the socket and the contact traces of a printed circuit board on which it is mounted. As warpage of the printed circuit boards is common, it is important to have terminals which have sufficient resiliency to compensate for the warpage. Additionally, as the socket and board have different coefficients of thermal expansion, the terminals must be able to compensate for relative movement to ensure that the solder connection between the mounting pads and traces is not rendered ineffective.

It would therefore be advantageous to provide a socket which has terminals which have sufficient resilient characteristics at both mating ends. In so doing misalignment in the mating components can be compensated and a positive electrical connection is affected.

SUMMARY OF THE INVENTION

The invention is directed to a terminal with use with a zero insertion force socket which electrically connects a mating connector to a printed circuit board or the like. The terminal has a pin engaging portion which has a pair of contact arms positioned to make electrical engagement with a mating pin. A retention portion extends from the pin engaging portion. Side edges of the retention portion are dimensioned to create a frictional interference with side wall of a cavity of the socket. A mounting portion extends from the retention portion in an opposite direction from the pin engaging portion. The mounting portion has at least one resilient leg which extends from the retention portion to a solder pad which is soldered to a substrate. The solder pad is spaced from the retention portion a sufficient distance to allow the at least one resilient leg to provide the resilient characteristics required to allow the at least one resilient leg to resiliently compensate for misalignment or movement of the solder relative to the solder pad.

In addition, the pin engaging portion has a pair of non-symmetrical contact arms which are positioned to make electrical engagement with a mating pin. A first contact arm of the pair of contact arms is configured to have a longer electrical path across which signals are transmitted than a second contact arm. The first contact arm also has a reduced width compared to the second contact arm, such that the first contact arm is configured to have a matched inductance to the second contact arm.

DETAILED DESCRIPTION OF THE INVENTION

Figure 1:
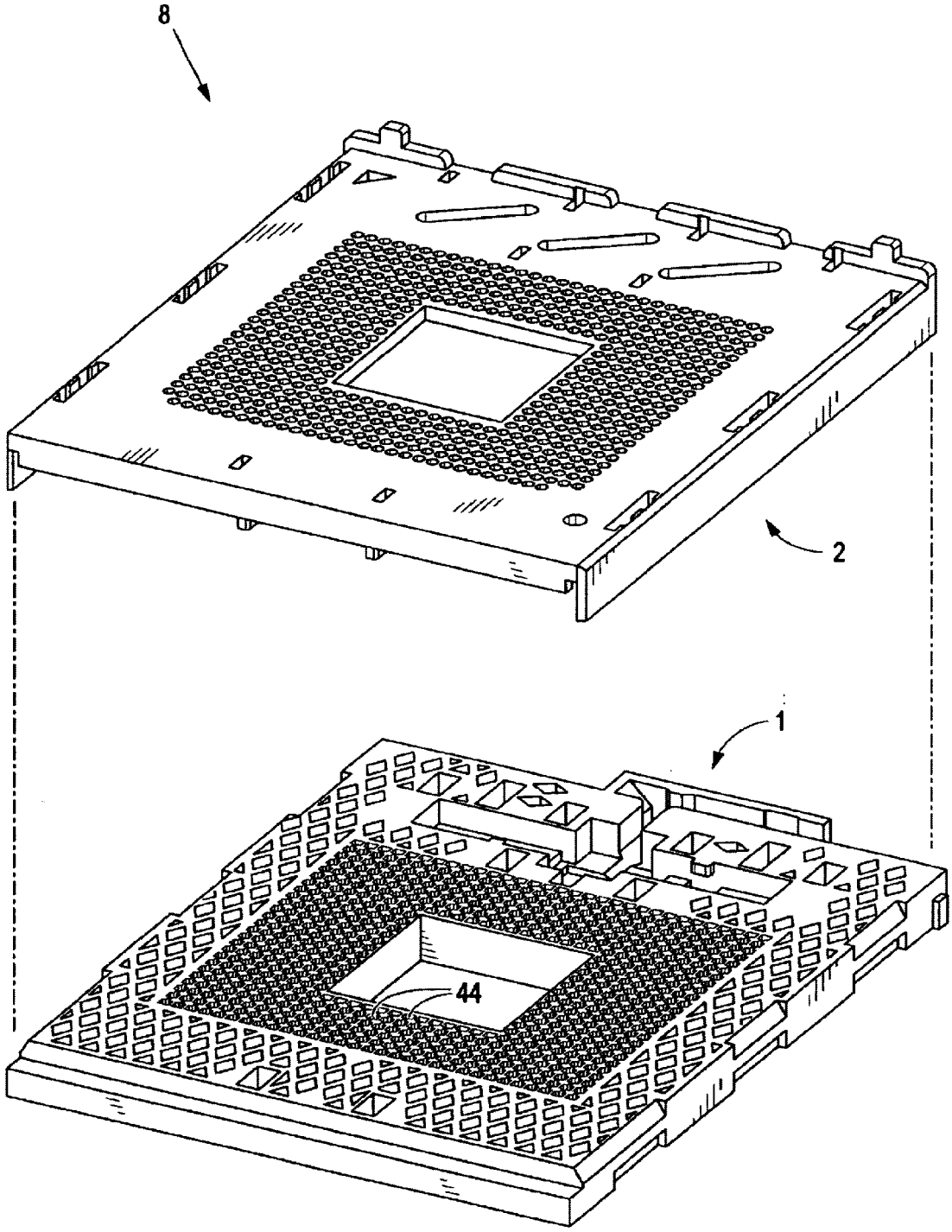
FIG. 1 is an exploded view of a ZIF socket in which terminals according to the present invention are inserted.

Referring to FIG. 1, a zero insertion force (ZIF) socket 8 in accordance with the present invention comprises a base 1, a cover 2 slidably mounted on the base 1, a plurality of terminals 3 received in the base 1, and a cam mechanism (not shown) arranged between the base 1 and the cover 2 for sliding the cover 2 relative to the base 1. The base 1 is mounted on a printed circuit board 4 (FIG. 7) and an electronic package (not shown) is positioned on the cover 2. The printed circuit board and the electronic package are electrically connected via the plurality of terminals 3 and a corresponding plurality of pins 5 (FIG. 4) which extend from the electronic package.

Figure 2:
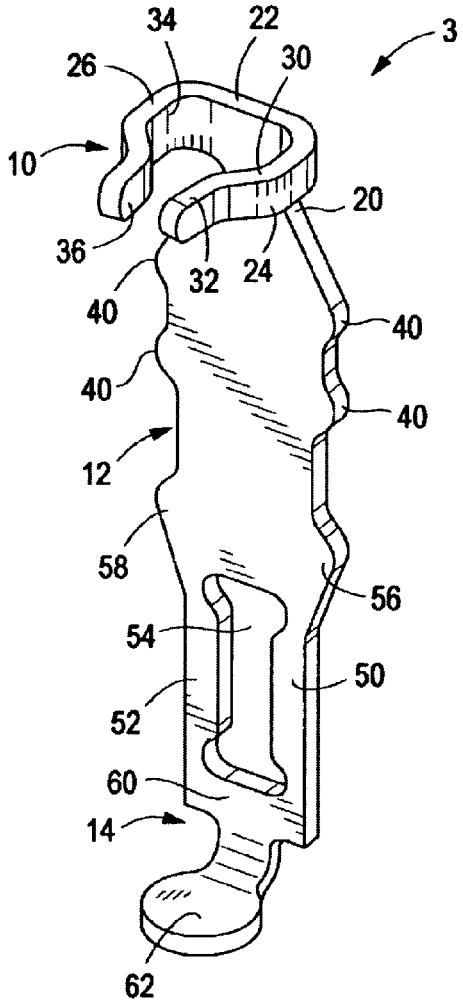
FIG. 2 is a perspective view of a terminal according to the present invention.

Referring to FIG. 2, each terminal 3 comprises a pin engaging portion 10, a retention portion 12, and a mounting portion 14. The engaging portion 10 has a neck 20 which extends to and is integral with the retention portion 12. A U-shaped bight 22 extends from the neck 20 at the opposite end from the retention portion 12. A pair of contact arms 24, 26 extend from the bight 22. Arm 24 has an arcuate portion 30 and a straight portion 32. Arm 26 also has an arcuate portion 34 and a straight portion 36. However, in the embodiment shown, arm 24 and arm 26 are not mirror images of each other. As is best shown in FIG. 3, the straight portions 32, 36 are angled toward each other such that the free ends of the portions 32, 36 are spaced from each other a distance less than the diameter of a respective pin 5.

Due to the particular configuration of each arm, arm 26 has a longer electrical path from its free end to bight 22. Therefore, as is best shown in FIG. 2, arm 26 has a reduced thickness to as compared to arm 24. This allows the inductance to be matched between each arm, even though the distance the signal must travel in the arms is divergent.

Figure 3:
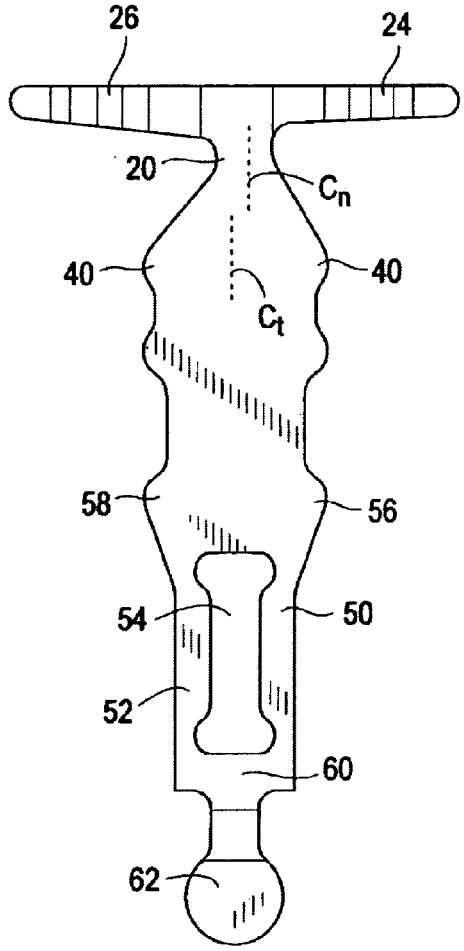
FIG. 3 is a two dimensional view of the terminal prior to forming.

Referring to FIG. 3, the centerline of the neck $C_n$ is offset from the centerline of the terminal $C_t$. This offset also contributes to the balance of the inductance.

The retention portion 12 extends from the neck 20. Oppositely facing edges 40 are provided on the retention portion. The side edges 40 are spaced from each other a greater distance than the side walls 42 of terminal housing cavities 44 in base 1, as will be more fully described below.

Figure 7:
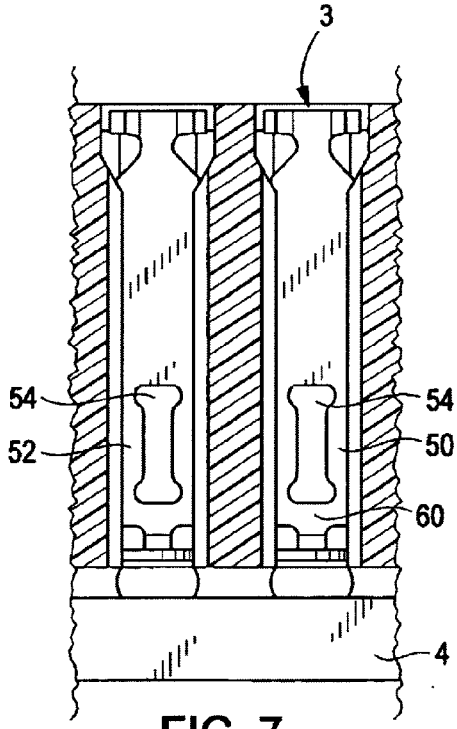
FIG. 7 is a cross sectional view illustrating the terminal positioned in the socket and mounted to a printed circuit board.

The mounting portion 14 extends from the bottom of the retention portion 12 in a direction opposed to the direction the neck 20 extends the top of the retention portion 12. As is best shown in FIGS. 2, 3 and 7, the mounting portion 14 has two resilient legs 50, 52 which extend from the retention portion 12. The resilient legs 50, 52 are separated by an opening 54. The opening can have various configurations, but in the embodiment shown, the opening has a dogbone configuration. Each leg 50, 52 has a positioning member 56, 58 extending in a direction away from opening 54. The positioning members 56, 58 are spaced from each other a distance less than the spacing of the side walls 42. A bridge 60 extends between legs 50, 52 at the end of the resilient legs which is spaced from the retention portion 12. In the embodiment shown, the positioning members 56, 58 are spaced from the bridge 60; however, other configurations are possible. Extending from bridge 60 is a solder pad 62 which is bent at approximately 90° with respect to the plane of the legs 50, 52. The bent portion of the solder pad 62 has a generally circular configuration to cooperate with a solder ball (not shown) placed in engagement with the printed circuit board 4. While a generally circular configuration is shown, the shape of the solder pad can be of various shapes, including generally square. The centerline of the solder pad 62 coincides with the center line of the terminal.

The terminals 3 are inserted into the terminal receiving cavities 44 provided in base 1. Each terminal 3 is generally inserted by positioning the pin engaging portion 10 into the cavity 44 and then moving the terminal upward into the cavity, such that the terminal is retained in the cavity. As the terminal is moved to the fully inserted position, the side edges 40 engage side walls 42. As the side edges 40 are spaced apart, as described above, the side edges engage and displace material from the side walls 42 to form a strong frictional engagement therebetween. It is important to note that flexibility and ability to compensate for board warpage and heat cycling are attributes of the terminal 3. Consequently, the fact that the side edges 40 and retention portion 12 are spaced from the solder pad 62 significantly increases the resiliency in the solder pad 62.

As the terminals 3 are inserted in the cavities 44, the positioning members 56, 58 enter slots provided in the side walls 42 of the cavities 44. The positioning members 56, 58 do not frictionally engage the walls 42 of the cavities and are, therefore, loosely retained in the cavities. This allows the mounting portion 14 to move relative to the cavity 44. By allowing the mounting portion 14, and in particular the solder pads 62, to float in this manner, a more stable connection is made with the circuit board. The ability of the terminals to thereby compensate for board warpage and thermal expansion is maximized. Consequently, after the terminals are soldered to the board, slight relative movement of the board 4 or the socket 8 is compensated by the mounting portion 14, thereby maintaining the integrity of the solder between the terminal and the board. The insures that a positive electrical connection will be maintained even as the board warpage or thermal expansion occurs.

Figure 4:
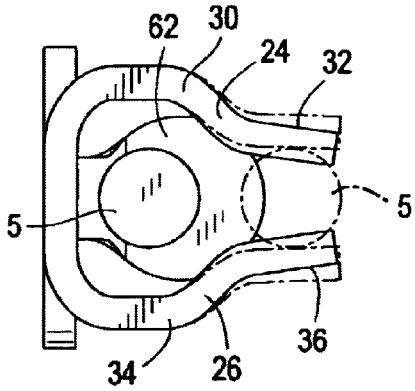
FIG. 4 is a top view of the terminal with the movement of a mating pin illustrated therein.
Figure 5:
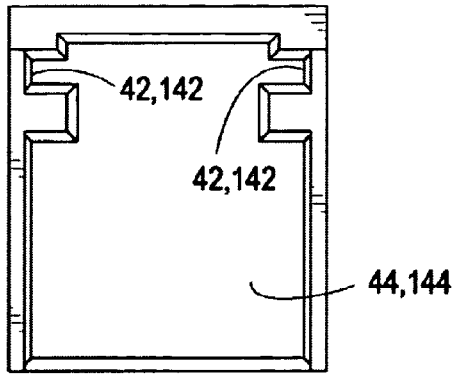
FIG. 5 is a top plan view of a cavity of the socket with no terminal inserted.

Referring to FIG. 4, when the electronic package is assembled on the ZIF socket 8, the cover 2 is positioned in an opened state, and each contact pin is inserted between the corresponding pair of contact arms 24, 26 without making contact therewith, thus the insertion force is zero. Rotating a handle of the cam mechanism causes the cover 2, together with the electronic package, to move relative to the base 1 to a closed position. As the cover is moved to the closed position, the pins 5 are moved toward and engage straight portions 32, 36 of the arms 24, 26 causing the arms 24, 26 to resiliently deform outward. In the closed position, the contact arms 24, 26 attempt to retain to their unstressed position, which exerts forces on pins 5. As each arm exerts an opposing force on the pins, the pins are retained in position and electrical connection is assured.

The electrical connection is assured even if respective pins are slightly misaligned or deformed. As the cover is moved to the closed position, the pin 5 first abuts against one of the arms 24, but does not contact the other arm 26. Since the pin 5 continuously moves toward the free ends of the arms 24, 26, the pin 5 pushes the arm 24, thereby causing the engaging portion 10 to rotate around the neck 20 due to the flexibility thereof. The other arm 26 moves toward the contact tail 5 to make contact therewith and establish reliable electrical connection therebetween.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

Figure 8:
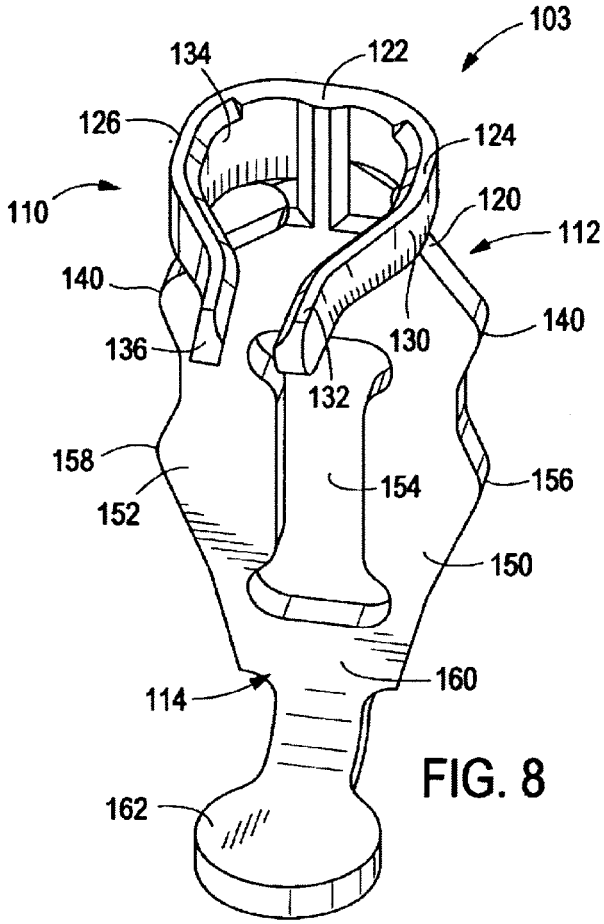
FIG. 8 is a perspective view of an alternate embodiment of a terminal according to the present invention.
Figure 6:
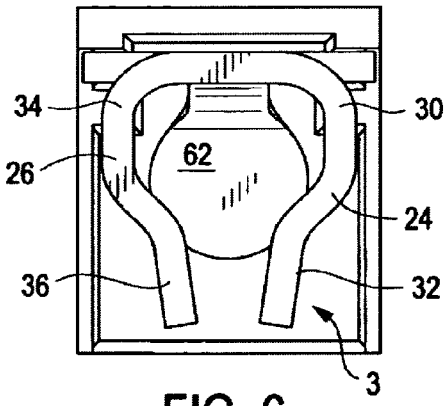
FIG. 6 is a to plan view of the cavity shown in FIG. 5 with a terminal inserted.

Referring to FIG. 8, an alternate embodiment of the invention is shown. The terminal 103 is more compact than terminal 3; however, many of the parts are essentially identical.

Each terminal 103 comprises a pin engaging portion 110, a retention portion 112, and a mounting portion 114. The engaging portion 110 has a neck 120 which extends to and is integral with the retention portion 112. A U-shaped bight 122 extends from the neck 120 at the opposite end from the retention portion 112. A pair of contact arms 124, 126 extend from the bight 122. Arm 124 has an arcuate portion 130 and a straight portion 132. Arm 126 also has an arcuate portion 134 and a straight portion 136. However, in the embodiment shown, arm 124 and arm 126 are not mirror images of each other. The straight portions 132, 136 are angled toward each other such that the free ends of the portions 132, 136 are spaced from each other a distance less than the diameter of a respective pin 5.

Due to the particular configuration of each arm, arm 126 has a longer electrical path from its free end to bight 122. Therefore, arm 126 has a reduced thickness to as compared to arm 124. This allows the inductance to be matched between each arm, even though the distance the signal must travel in the arms is divergent. The centerline of the neck is offset from the centerline of the terminal. This offset also contributes to the balance of the inductance.

As shown in FIG. 8, the arms 124, 126 and bight 122 have reduced material thickness in high stress areas. The reduced thickness allows the arms to have an increased yield stress, thereby increasing the compliancy of the arms and reducing the spring rate.

The retention portion 112 extends from the neck 120. Oppositely facing edges 140 are provided on the retention portion. The side edges 140 are spaced from each other a greater distance than the side walls 42 of terminal housing cavities 44 in base 1.

The mounting portion 114 extends from the bottom of the retention portion 112 in a direction opposed to the direction the neck 120 extends the top of the retention portion 112. The mounting portion 14 has two resilient legs 150, 152 which extend from the retention portion 112. The resilient legs 150, 152 are separated by an opening 154. The opening can have various configurations, but in the embodiment shown, the opening has a dogbone configuration. Each leg 150, 152 has a positioning member 156, 158 extending in a direction away from opening 154. The positioning members 156, 158 are spaced from each other a distance less than the spacing of the side walls 142. A bridge 160 extends between legs 150, 152 at the end of the resilient legs which is spaced from the retention portion 112. In the embodiment shown, the positioning members 156, 158 are spaced from the bridge 160; however, other configurations are possible. Extending from bridge 160 is a solder pad 162 which is bent at approximately 90° with respect to the plane of the legs 150, 152. The bent portion of the solder pad 162 has a generally circular configuration to cooperate with a solder ball (not shown) placed in engagement with the printed circuit board 4. While a generally circular configuration is shown, the shape of the solder pad can be of various shapes, including generally square. The centerline of the solder pad 162 coincides with the center line of the terminal.

As the terminals 103 are inserted into the cavities 144 in essentially the same manner as terminals 3, the description thereof will not be repeated.

What is claimed is:

1. A terminal for use with a socket, the terminal comprising:

a pin engaging portion having a pair of contact arms which are positioned to make electrical engagement with a mating pin;

a retention portion extending from the pin engaging portion, side edges of the retention portion being dimensioned to create a frictional interference with side walls of a cavity of the socket;

a mounting portion extending from the retention portion in an opposite direction from the pin engaging portion, the mounting portion having two resilient legs, each resilient leg having an end, the two resilient legs are separated by an opening, the opening extending from proximate the retention portion to a bridge which extends between the two resilient legs at the end of each resilient leg, and the mounting portion having an end which is configured to be soldered to a substrate.

2. The terminal as recited in claim 1 wherein the retention portion is positioned proximate the pin engaging portion, a neck member integrally attaches the pin engaging portion to the retention portion, the neck member providing the flexibility required between the retention portion and the pin engaging portion to allow the pin engaging portion to move relative to the retention portion to compensate for respective mating pins which are slightly misaligned.

3. The terminal as recited in claim 1 wherein the mounting portion has a pair of positioning members that are loosely received in slots provided in the socket to allow for movement of the two resilient legs relative to the retention portion.

4. The terminal as recited in claim 1 wherein the contact arms have a reduced material thickness in high stress areas to increase the compliancy of the contact arms and reduce the spring rate.

5. The terminal as recited in claim 1 wherein the pair of contact arms are nonsymmetrical, a first contact arm of the pair of contact arms is configured to have a longer electrical path across which signals are transmitted than a second contact arm.

6. The terminal as recited in claim 5 wherein a bight integrally connects the first and second arms together, a centerline of the bight is offset from a centerline of the terminal.

7. The terminal as recited in claim 6 wherein the first contact arm has a reduced thickness compared to the second contact arm, whereby the first contact arm is configured to have a matched inductance to the second contact arm.

8. A terminal for use with a socket, the terminal comprising:

a pin engaging portion having a pair of nonsymmetrical contact arms which are positioned to make electrical engagement with a mating pin, a first contact arm of the pair of contact arms is configured to have a longer electrical path across which signals are transmitted than a second contact arm, the first contact arm has a reduced thickness compared to the second contact arm, whereby the first contact arm is configured to have a matched inductance to the second contact arm;

a retention portion extending from the pin engaging portion, side edges of the retention portion being dimensioned to create a frictional interference with side walls of a cavity of the socket; and a mounting portion extending from the retention portion in an opposite direction from the pin engaging portion, the mounting portion having a solder pad for soldering to a substrate;

wherein the mounting portion has two resilient legs which extend from the retention portion, each resilient leg having an end;

wherein the two resilient legs are separated by an opening, the opening extending from proximate the retention portion to a bridge which extends between the two resilient legs at the end of each resilient leg.

9. The terminal as recited in claim 8 wherein a bight integrally connects the first and second arms together, a centerline of the bight is offset from a centerline of the terminal.

10. The terminal as recited in claim 8 wherein the retention portion is positioned proximate the pin engaging portion, a neck member integrally attaches the pin engaging portion to the retention portion, the neck member providing the flexibility required between the retention portion and the pin engaging portion to allow the pin engaging portion to move relative to the retention portion to compensate for respective mating ping which are slightly misaligned.

11. The terminal as recited in claim 8 wherein the solder pad is spaced from the retention portion a sufficient distance to allow the two resilient legs to resiliently compensate for misalignment or movement of the solder relative to the molder pad.

12. The terminal as recited in claim 8 wherein the contact arms have a reduced material thickness in high stress areas to increase the compliancy of the contact arms and reduce the spring rate.

13. The terminal as recited in claim 8 wherein the two resilient legs have positioning members extending there from at a distance spaced train the retention portion, the positioning members cooperate with slots provided in the socket and are loosely retained therein to allow for movement of the two resilient legs relative to the retention portion.

14. The terminal as recited in claim 13 wherein the positioning members axe positioned proximate the solder pad such that the lateral movement of the solder pad will be controlled.

* * * * *